US005549466A

United States Patent [19]

Hori et al.

[11] Patent Number: 5,549,466

[45] Date of Patent: Aug. 27, 1996

[54] SCROLL COMPRESSOR HAVING A CENTERING RECESS FOR ASSEMBLY

[75] Inventors: Tatsuya Hori, Fujisawa; Hiroyuki Fukuhara, Ōtsu; Shigeru Muramatsu, Kusatsu; Sadayuki Yamada, Ōtsu, all of Japan

[73] Assignees: Matsushita Electric Industrial Co., Ltd, Osaka-fu; Matsushita Seiko Co., Ltd., Osaka, both of Japan

[21] Appl. No.: 333,341

[22] Filed: Nov. 2, 1994

[30] Foreign Application Priority Data

Nov. 4, 1993 [JP] Japan ..... 5-275252

[51] Int. Cl.[6] ..... F04C 18/04

[52] U.S. Cl. ..... 418/55.1; 29/888.022

[58] Field of Search ..... 418/55.1, 55.2; 29/888.022

[56] References Cited

U.S. PATENT DOCUMENTS 5,102,316 4/1992 Caillat et al. ..... 418/55.5
5,188,520 2/1993 Nakamura et al. ..... 418/55.1
5,213,489 5/1993 Kawahara et al. ..... 418/55.1
5,267,844 12/1993 Grassbaugh Jr. ..... 417/902

FOREIGN PATENT DOCUMENTS 2-5780 1/1990 Japan ..... 418/55.1
4-112983 4/1992 Japan ..... 418/55.1

*Primary Examiner*—John J. Vrablik
*Attorney, Agent, or Firm*—Wenderoth, Lind & Ponack

[57] ABSTRACT

A scroll compressor includes a scroll assembly accommodated in a closed container, a crankshaft for driving the scroll assembly, a main bearing for rotatably supporting one end of the crankshaft, and an auxiliary bearing for rotatably supporting the other end of the crankshaft. A recess is defined between the internal surface of the closed container and the external surface of a compression section comprised of the scroll assembly and the main bearing. A portion of a jig is inserted into the recess to achieve concentricity and parallelism of the auxiliary bearing with respect to the main bearing using reference planes defined in the auxiliary bearing and the compression section or by radially adjusting the auxiliary bearing.

4 Claims, 8 Drawing Sheets

SCROLL COMPRESSOR HAVING A CENTERING RECESS FOR ASSEMBLY

BACKGROUND OF THE INVENTION

1. Field of the Invention

The present invention relates to an electrically-operated scroll compressor and, also, to a method of assembling the same.

2. Description of Related Art

FIGS. 6 and 7 depict a conventional scroll compressor. As shown therein, a closed container 1 made up of a cylindrical section 1*a* and a lid section 1*b* accommodates an electric motor 2 and a scroll assembly 3 disposed above the electric motor 2. The electric motor 2 comprises a stator 2*a* and a rotor 2*b* to drive the scroll assembly 3. The scroll assembly 3 comprises a stationary scroll 3*a* having a wrap element 3*a'* integrally formed therewith and an orbiting scroll 3*b* having an orbiting wrap element 3*b'* integrally formed therewith so as to engage with the stationary wrap element 3*a'*. A plurality of compression spaces are delimited by the stationary wrap element 3*a'* and the orbiting wrap element 3*b'*. The closed container 1 also accommodates a crank shaft 4 for driving the orbiting scroll 3*b*, a main bearing 5 for supporting a main shaft 4' formed on one end of the crank shaft 4, and an auxiliary bearing 6 disposed on the side opposite to the main bearing 5 to support the other end of the crank shaft 4. The main bearing 5 and the auxiliary bearing 6 are rigidly secured to the internal surface of the closed container 1.

The orbiting wrap element 3*b'* and the stationary wrap element 3*a'* are maintained in fixed angular relationship to each other by the use of an Oldham ring 7. The Oldham ring 7 restrains the orbiting scroll 3*b* from angular displacement while permitting it to undergo circular translation with a variable circular orbiting radius.

The closed container 1 further accommodates a discharge muffler 8 disposed above the scroll assembly 3 and has a discharge chamber 12 defined between the discharge muffler 8 and the stationary scroll 3*a*. A discharge pipe 10 communicating with the discharge chamber 12 extends through the cylindrical section 1*a* of the closed container 1 to discharge compressed gas to the outside of the closed container 1. The closed container 1 also has a suction pipe 9 for sucking gas to be compressed from outside, and a check valve 11 mounted on the stationary scroll 3*a* to prevent reversing motion of the scroll assembly 3.

The scroll compressor of the above-described construction operates as follows.

Low-pressure gas returns through the suction pipe 9 and is introduced to the scroll assembly 3. The gas is then compressed to high-pressure gas by the scroll assembly 3 in which the orbiting scroll 3*b* undergoes circular translation with respect to the stationary scroll 3*a*. Thereafter, the high-pressure gas is discharged outside the closed container 1 from the discharge pipe 10, and again low-pressure gas is returned through the suction pipe 9 and circulated to form a well-known compression cycle.

A method of assembling the scroll compressor of FIG. 6 is discussed hereinafter with reference to FIG. 7.

The stator 2*a* and the rotor 2*b* of the electric motor 2 are secured to the cylindrical section 1*a* of the closed container 1 and to the crank shaft 4, respectively, by means of shrinkage fit. The scroll assembly 3 and the main bearing 5 are secured to each other by means of bolts, and the crank shaft 4 is appropriately mounted on the main bearing 5.

As shown in FIG. 7, after the scroll assembly 3, the main bearing 5, and the crank shaft 4 have been assembled, this assembly is inserted into the cylindrical section 1*a*, and the main bearing 5 is welded to the cylindrical section 1*a* on the basis of the inside diameter of the cylindrical section 1*a*. Then, the auxiliary bearing 6 is inserted into and welded to the cylindrical section 1*a* on the basis of the inside diameter of the cylindrical section 1*a*.

Because the conventional compressor shown in FIG. 7 uses the inside diameter of the cylindrical section 1*a* as a reference, which has limitations in accuracy, it is difficult to concentrically align the main bearing 5 with the auxiliary bearing 6.

FIG. 8 depicts another assembling method as disclosed in Japanese Laid-open Patent Publication (unexamined) No. 4-143475. According to this disclosure, the cylindrical section 1*a* of the closed container 1 has two stepped portions 1*e* formed on the internal surface thereof for receiving the main bearing 5 and the auxiliary bearing 6, respectively.

The stator 2*a* and the rotor 2*b* of the electric motor 2 are first secured to the cylindrical section 1*a* and to the crank shaft 4, respectively, by means of shrinkage fit. The main bearing 5 and the auxiliary bearing 6 are then inserted into the cylindrical section 1*a* until they are brought into contact with associated stepped portions 1*e* of the cylindrical section 1*a*. Thereafter, the two bearings 5 and 6 are welded to the cylindrical section 1*a* while they are being concentrically aligned with each other, and the scroll assembly 3 is secured to the main bearing 5.

In the conventional compressor shown in FIG. 8, because the scroll assembly 3 and the main bearing 5 are assembled after undergoing the welding process, foreign substances are likely to enter the scroll assembly 3. As a result, there arises a problem in that high-accuracy assemblage is difficult.

SUMMARY OF THE INVENTION

The present invention has been developed to overcome the above-described disadvantages.

It is accordingly an objective of the present invention to provide an improved scroll compressor that can be assembled with high accuracy.

Another objective of the present invention is to provide a method of assembling a scroll compressor with high accuracy.

In accomplishing the above and other objectives, the scroll compressor according to the present invention comprises a closed container having a cylindrical section and a lid section, an electric motor accommodated in the closed container, and a scroll assembly driven by the electric motor and comprising a stationary scroll and an orbiting scroll. The stationary and orbiting scrolls have respective wrap elements in engagement with each other. The scroll compressor also comprises a crankshaft for driving the orbiting scroll, a first bearing secured to the cylindrical section for supporting a first end of the crankshaft, and a second bearing secured to the cylindrical section for supporting a second end of the crankshaft.

A recess is defined between the internal surface of the cylindrical section and the external surface of a compression section comprised of the first bearing and the scroll assembly. The external surface of the compression section is concentrically aligned with the external surface of the first end of the crankshaft, and the recess is used for insertion of a portion of a jig thereinto for centering of the first bearing.

Conveniently, the stationary scroll and the second bearing have respective flat planes defined therein that are set parallel to each other.

The second bearing may be comprised of a frame portion and a bearing portion carried by the frame portion so that the bearing portion can be radially adjusted relative to the frame portion.

Alternatively, the compression section may have a plurality of holes defined therein, in place of the recess, for insertion of associated pins of a jig thereinto for centering of the first bearing.

In another aspect of the present invention, a method of assembling the scroll compressor comprising the steps of:

(a) assembling the first bearing and the scroll assembly into the compression section;

(b) inserting the compression section into the cylindrical section of the closed container;

(c) inserting a portion of a jig into a recess defined between the internal surface of the cylindrical section and the external surface of the compression section for centering of the first bearing;

(d) concentrically aligning the compression section with the second bearing;

(e) setting a flat plane defined in the compression section parallel to a flat plane defined in the second bearing; and (f) securing the first and second bearings to the cylindrical section.

Alternatively, the step (c) above may be replaced by the step of inserting a plurality of pins of a jig into associated holes defined in the compression section for centering of the first bearing.

In a further aspect of the present invention, a method of assembling the scroll compressor comprising the steps of:

assembling the first bearing and the scroll assembly into the compression section;

inserting the compression section into the cylindrical section of the closed container;

setting a flat plane defined in the compression section parallel to a flat plane defined in the frame portion of the second bearing, said flat planes being perpendicular to the axial direction of the compression section;

securing the frame portion of the second bearing to the cylindrical section;

radially adjusting the bearing portion of the second bearing relative to the frame portion of the second bearing; and securing the bearing portion to the frame portion of the second bearing.

According to the present invention, the compression section can be assembled under a clean condition, and the compression section can be then inserted into and welded to the cylindrical section of the closed container. Also, it has become possible to achieve concentricity and parallelism of the auxiliary bearing (second bearing) with respect to the main bearing (first bearing) using reference planes defined in the auxiliary bearing and the compression section or by radially adjusting the auxiliary bearing, thus facilitating assemblage of the scroll compressor and increasing the reliability thereof.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Referring now to the attached drawings, several embodiments of the present invention will be described in detail hereinafter.

Figure 1:
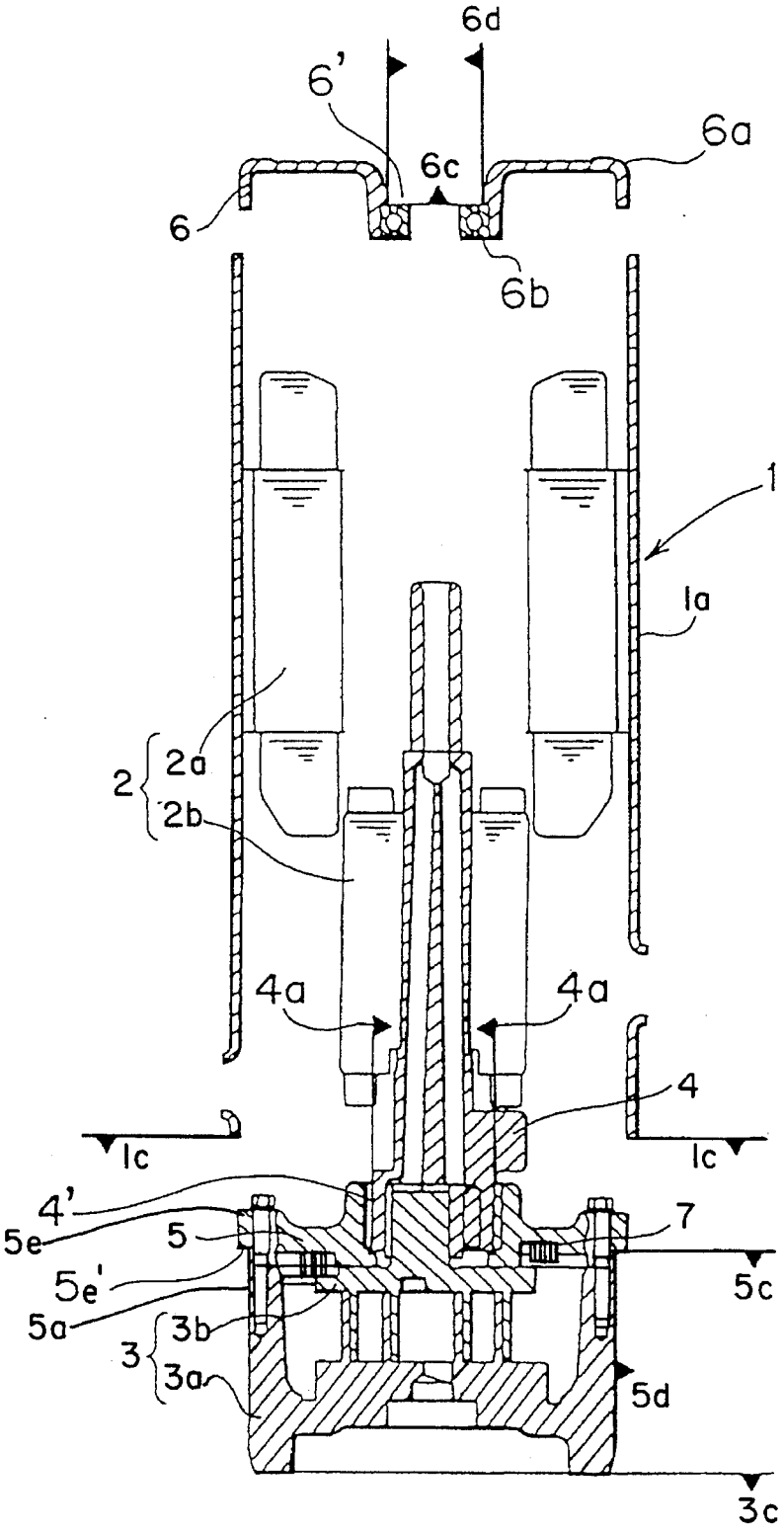
FIG. 1 is an exploded vertical sectional view of a scroll compressor according to a first embodiment of the present invention.

FIG. 1 depicts a scroll compressor according to a first embodiment of the present invention.

As shown in FIG. 1, a closed container 1 is made up of a cylindrical section 1*a* and a lid section (not shown), and accommodates an electric motor 2 and a scroll assembly 3 driven by the electric motor 2. The electric motor 2 comprises a stator 2*a* and a rotor 2*b*. The scroll assembly 3 comprises a stationary scroll 3*a* having a wrap element integrally formed therewith and an orbiting scroll 3*b* having an orbiting wrap element integrally formed therewith so as to engage with the stationary wrap element. A plurality of compression spaces are delimited by the stationary wrap element and the orbiting wrap element. The closed container 1 also accommodates a crank shaft 4 for driving the orbiting scroll 3*b*, a main bearing 5 for rotatably supporting a main shaft 4' formed on one end of the crank shaft 4, and an auxiliary bearing 6 disposed on the side opposite to the main bearing 5 to rotatably support the other end of the crank shaft 4. The main bearing 5 and the auxiliary bearing 6 are rigidly secured to the internal surface of the closed container 1. An Oldham ring 7 restrains the orbiting scroll 3*b* from angular displacement while permitting it to undergo circular translation with a variable circular orbiting radius.

Figure 6:
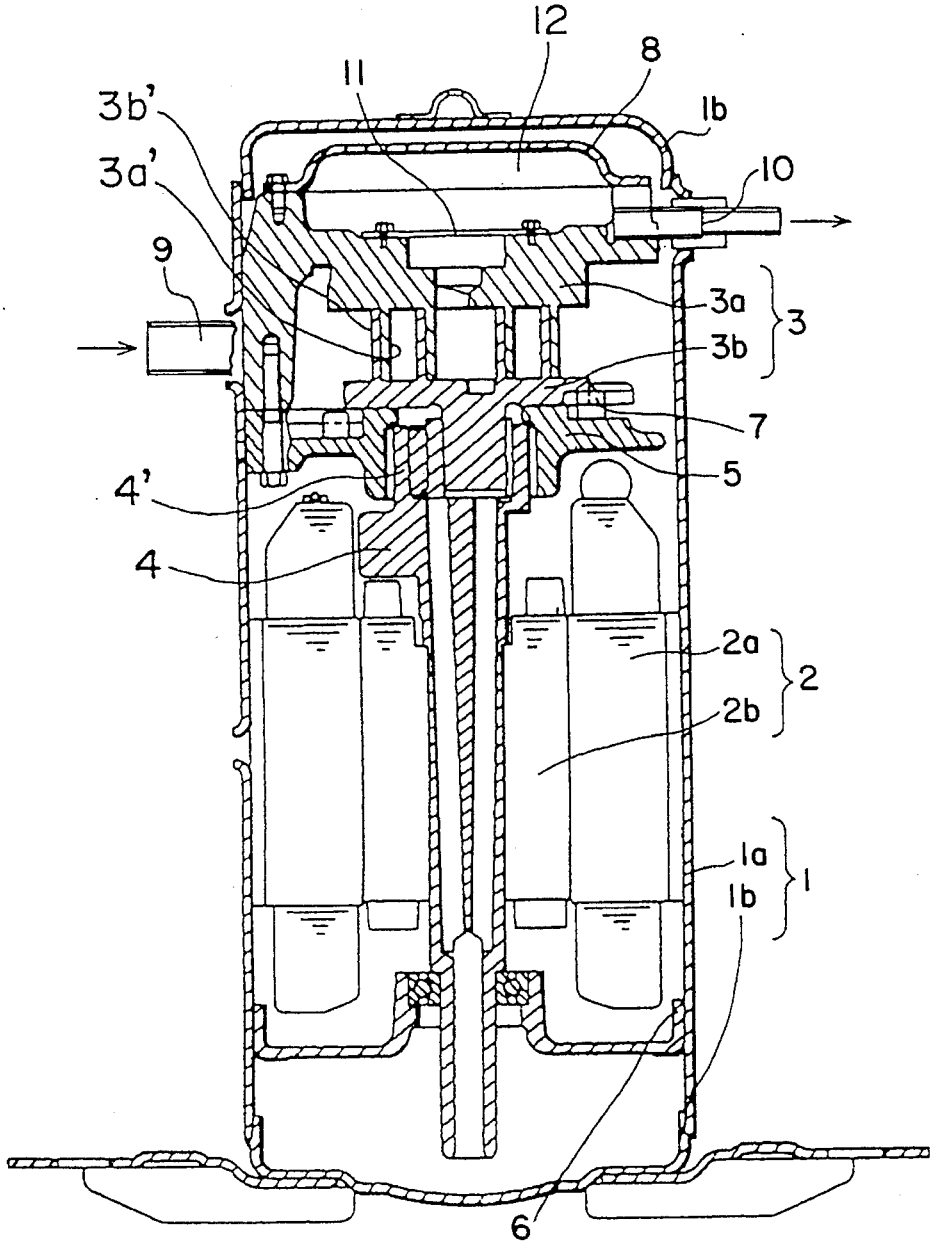
Fig. 6 PRIOR ART
FIG. 6 is a vertical sectional view of a conventional scroll compressor.
Figure 7:
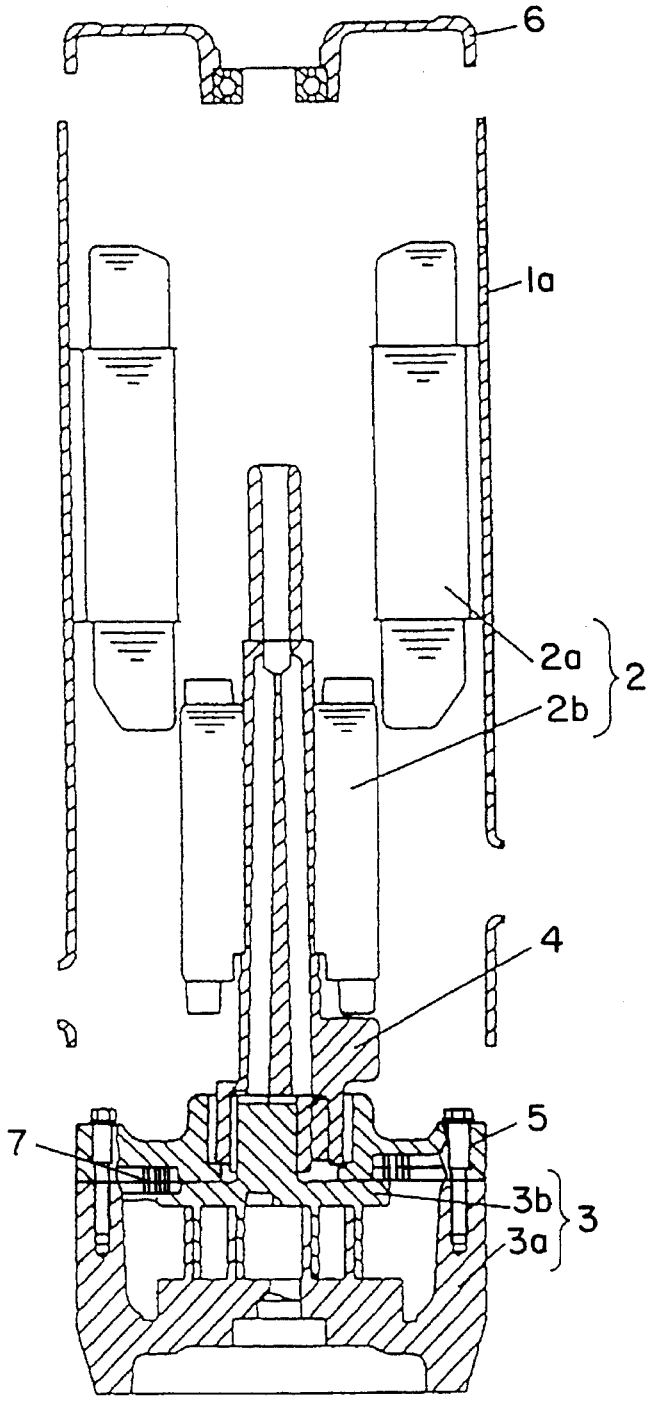
Fig. 7 PRIOR ART
FIG. 7 is an exploded vertical sectional view of the scroll compressor of FIG. 6 during assemblage.
Figure 8:
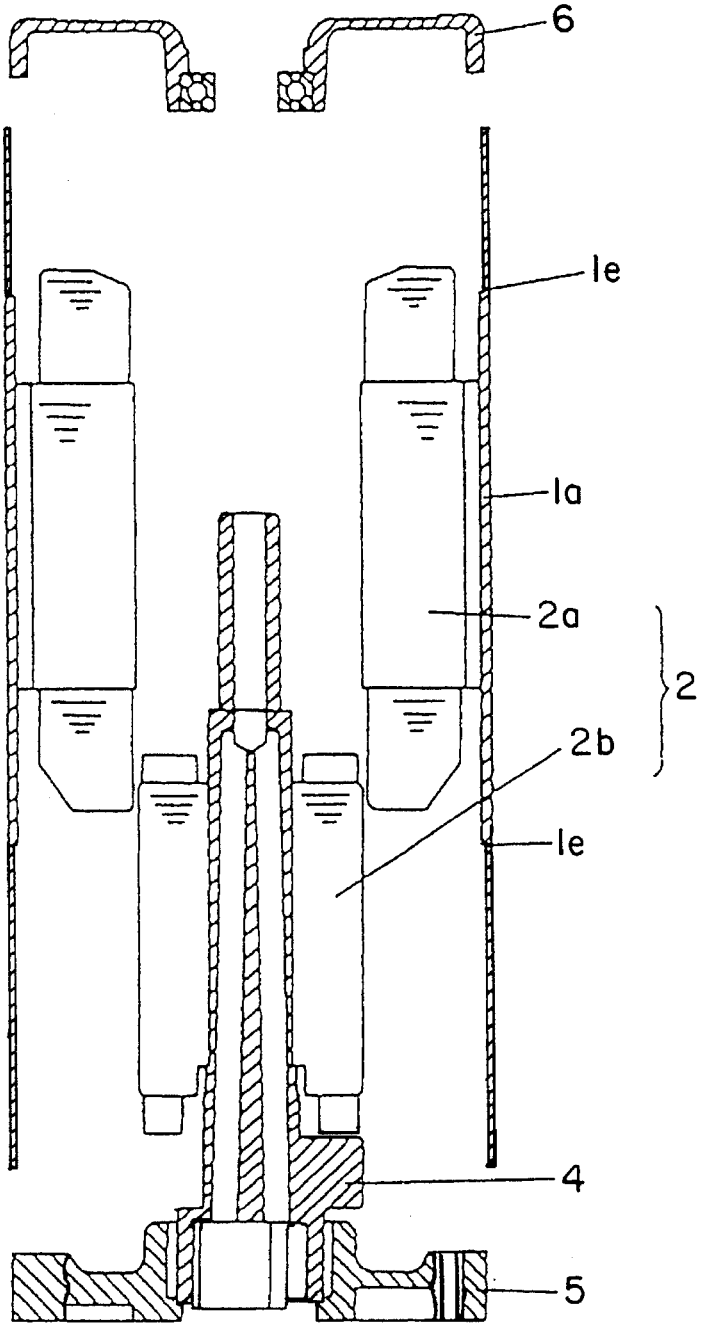
Fig. 8 PRIOR ART
FIG. 8 is an exploded vertical sectional view of another conventional scroll compressor during assemblage.

The above and other basic structures of the scroll compressor of FIG. 1 are identical to those of the conventional scroll compressor shown in FIG. 6. The scroll compressor of FIG. 1, however, differs in construction from the conventional compressor in the following respects.

In the scroll compressor shown in FIG. 1, a compression section comprised of the scroll assembly 3 and the main bearing 5 has a recess 5*a* defined on the external surface thereof. The recess 5*a* is delimited by an axially facing annular surface 5*e'* of a radially outwardly projecting portion 5*e* of the bearing 5, the surface 5*e'* lying in a horizontally extending flat plane 5*c*, and a vertically extending cylindrical plane 5*d*, both formed on the external surface of the compression section. The cylindrical plane 5*d* is concentric with the external cylindrical surface 4*a* of the main shaft 4' of the crank shaft 4.

Alternatively, the compression section may have a horizontally extending flat plane 3c formed atop the stationary scroll 3a in place of the flat plane 5c.

In association with the above configuration, the auxiliary bearing 6, comprised of a frame portion 6a and a bearing portion 6b carried by the frame portion 6a, has a recess 6' defined therein at the center thereof. The recess 6' is concentrically aligned with the bearing portion 6b and is delimited by a vertically extending cylindrical plane 6d.

During assemblage of the scroll compressor, it is particularly important to set the horizontally extending flat plane 3c or 5c of the compression section parallel to a horizontally extending flat plane 6c defined by the external surface of the bearing portion 6b of the auxiliary bearing 6. At the same time, it is necessary to concentrically align the cylindrical plane 6d of the auxiliary bearing 6 with the external cylindrical surface 4a of the main shaft 4' of the crank shaft 4.

According to the above-described embodiment, under the clean atmosphere such as a dust-proof room it has become possible to temporarily assemble the scroll assembly 3, the main bearing 5, and the crank shaft 4, determine an angular relationship between the stationary wrap element and the orbiting wrap element, and fix the stationary scroll 3a and the main bearing 5 with bolts. This assembly is then inserted into and appropriately welded to the cylindrical section 1a of the closed container 1 with the horizontally extending flat plane 3c or 5c of the compression section set parallel to the lower end 1c of the cylindrical section 1a.

Figure 2:
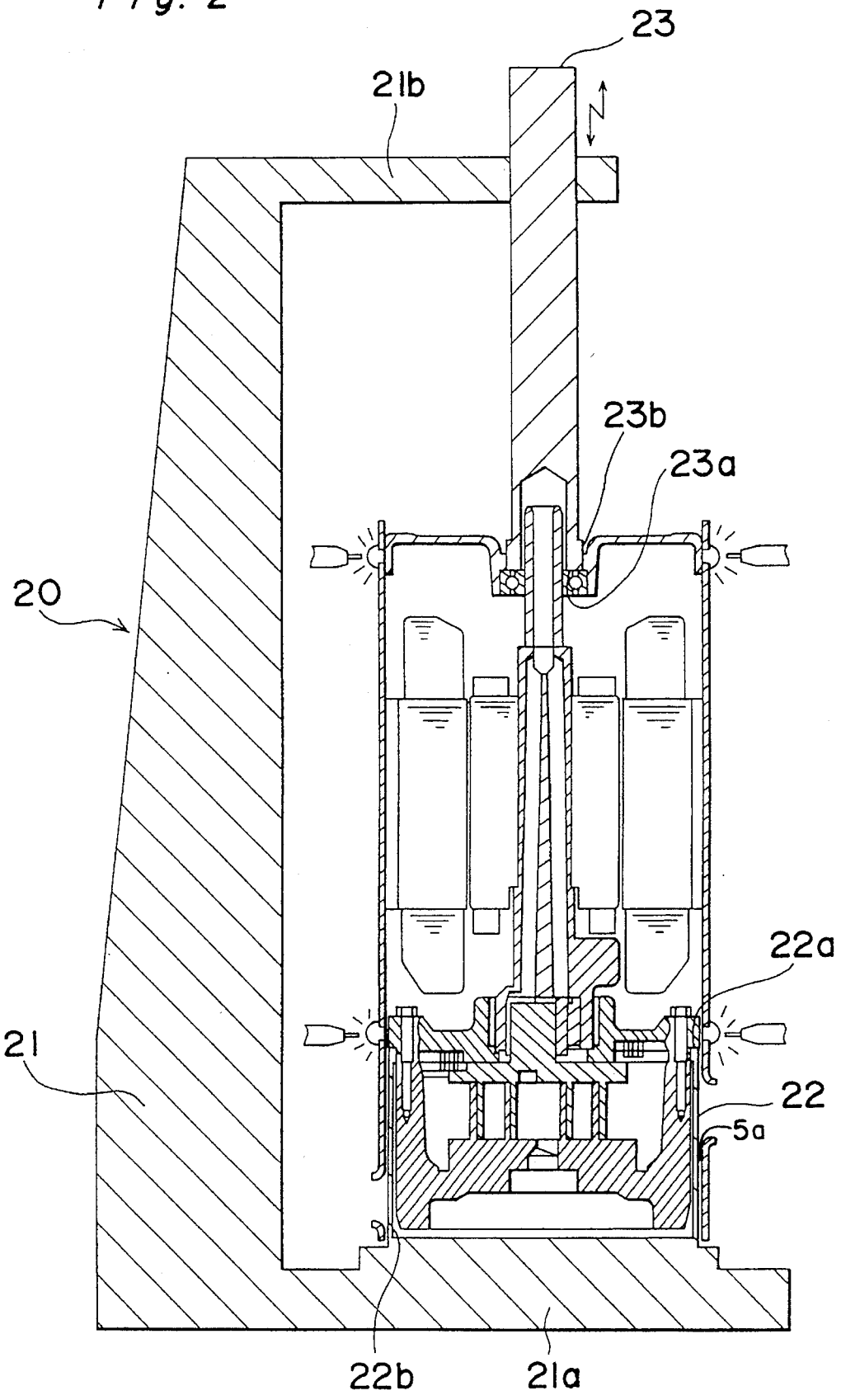
FIG. 2 is a vertical sectional view of the scroll compressor of FIG. 1 assembled by a jig.

FIG. 2 depicts the scroll compressor of the present invention that is being assembled by a jig 20. The jig 20 comprises a frame 21 having a cylindrical compression section carrier 22 formed on a base 21a thereof and a rod-shaped auxiliary bearing carrier 23 axially slidably supported by a top bar 21b of the frame 21. The compression section carrier 22 has the upper surface 22a parallel to the lower surface 23a of the auxiliary bearing carrier 23, and also has the internal cylindrical surface 22b concentrically aligned with the lower external surface 23b of the auxiliary bearing carrier 23.

As shown in FIG. 2, during assemblage, the compression section carrier 22 is inserted into the recess 5a of the compression section encircled by the cylindrical section 1a of the closed container 1 until the upper surface 22a of the compression section carrier 22 is brought into contact with the horizontally extending flat plane 5c of the compression section. Then, the auxiliary bearing carrier 23 whose lower end is received in the recess 6' of the auxiliary bearing 6 is moved downwardly and inserted into the cylindrical section 1a so that the external peripheral portion of the frame portion 6a of the auxiliary bearing 6 may be appropriately welded to the cylindrical section 1a.

The use of the jig 20 can render the vertically extending cylindrical plane 5d of the compression section to be concentrically aligned with the vertically extending cylindrical plane 6d of the auxiliary bearing 6, and also can render the horizontally extending flat plane 5c of the compression section to be parallel to the horizontally extending flat plane 6c of the auxiliary bearing 6. That is, the use of the cylindrical plane 5d of the compression section and the cylindrical plane 6d of the auxiliary bearing 6 as the vertical reference planes ensures centering of the main bearing 5 and the auxiliary bearing 6, while the use of the flat plane 5c of the compression section and the flat plane 6c of the auxiliary bearing 6 as the horizontal reference planes makes it possible to set the lower end 1c of the cylindrical section 1a parallel to the flat plane 6c of the auxiliary bearing 6.

Accordingly, not only can the scroll assembly 3 be assembled under a clean condition, but also the main bearing 5 and the auxiliary bearing 6 can be assembled together with high accuracy.

Where the horizontally extending flat plane 3c formed atop the stationary scroll 3a is used as the horizontal reference plane, it is necessary to employ another jig having a compression section carrier lower than that shown in FIG. 2. In this case, the compression section carrier 22 is inserted into the recess 5a of the compression section until the flat plane 3c is brought into contact with the upper surface of the base 21a.

Furthermore, the lower end 1c of the cylindrical section 1a can be used as the horizontal reference plane with the use of still another jig that allows it to be in contact with the upper surface of the base 21a.

Figure 3:
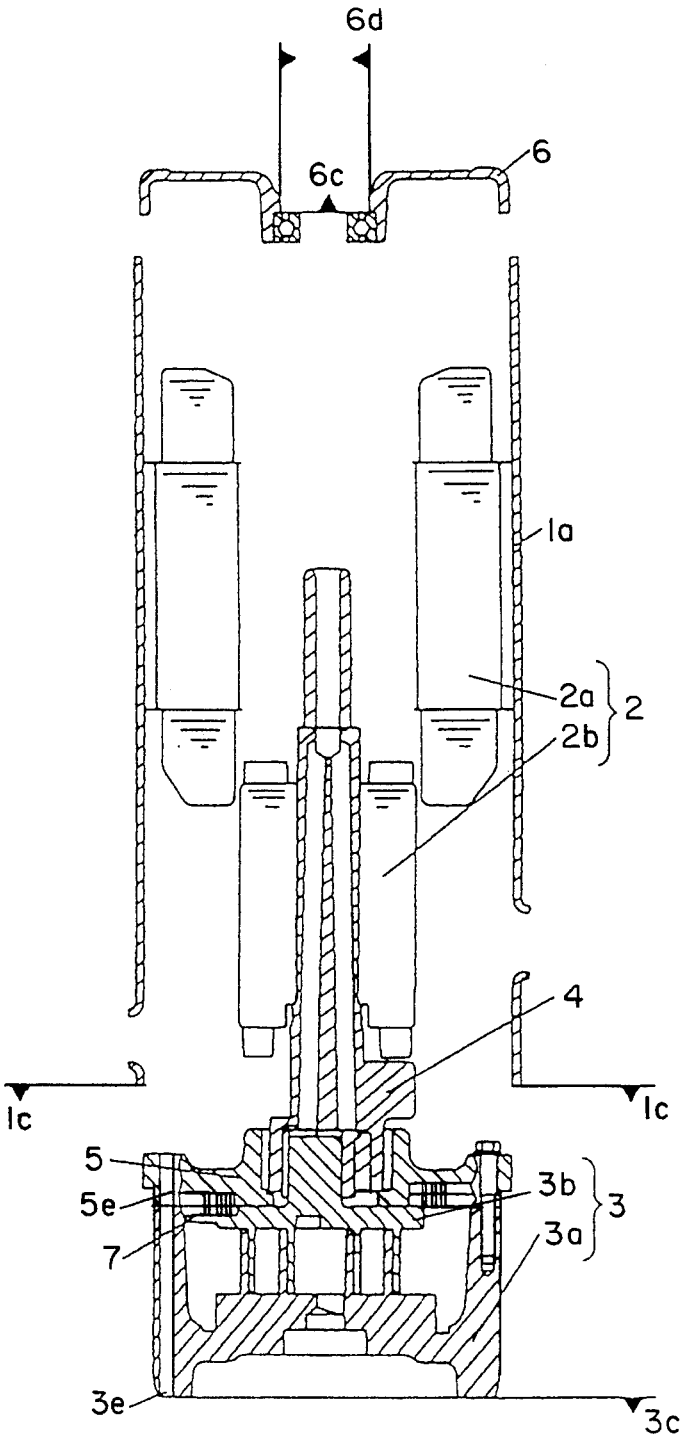
FIG. 3 is a view similar to FIG. 1, but according to a second embodiment of the present invention.

FIG. 3 depicts a scroll compressor according to a second embodiment of the present invention.

The scroll compressor shown in FIG. 3 has two vertically extending reference holes 5e (only one is illustrated) defined in the main bearing 5 and two vertically extending holes 3e (only one is illustrated) defined in the stationary scroll 3a. The holes 3e are concentrically aligned with associated reference holes 5e and have a diameter slightly greater than the latter.

Figure 4:
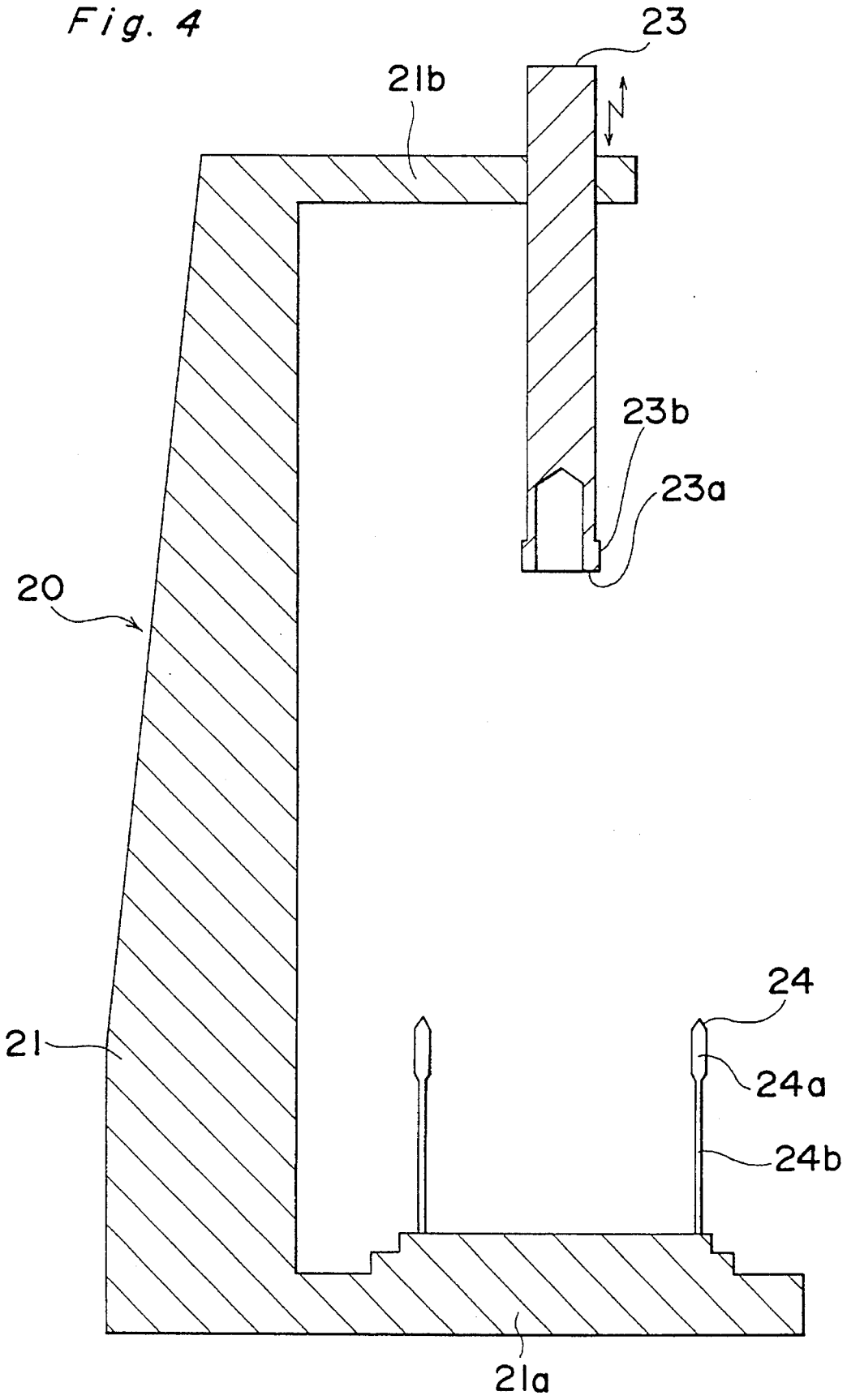
FIG. 4 is a vertical sectional view of a jig for use in assembling the scroll compressor of FIG. 3.

FIG. 4 depicts a jig 20' having two pins 24 extending vertically upwardly from the base 21a of the frame 21. The other structure of the jig 20' except for these pins 24 is the same as that of the jig 20 shown in FIG. 2.

Each of the pins 24 has an upper portion 24a of a diameter slightly smaller than the inner diameter of the reference holes 5e, and also has a lower portion 24b of a diameter smaller than the upper portion 24a.

During assemblage, the two pins 24 are inserted into associated reference holes 5e for centering of the main bearing 5, while the centering of the auxiliary bearing 6 is effected using the auxiliary bearing carrier 23, as in the first embodiment. In this case, however, either the flat plane 3c of the stationary scroll 3a or the lower end 1c of the cylindrical section 1a is used as the horizontal reference plane for the compression section. In general, the compression section having the vertical reference holes 5e does not have the horizontally extending flat plane 5c shown in FIG. 1.

As is the case with the first embodiment, according to the second embodiment of the present invention, not only can the scroll assembly 3 be assembled under a clean condition, but also the main bearing 5 and the auxiliary bearing 6 can be assembled together with high accuracy.

Figure 5:
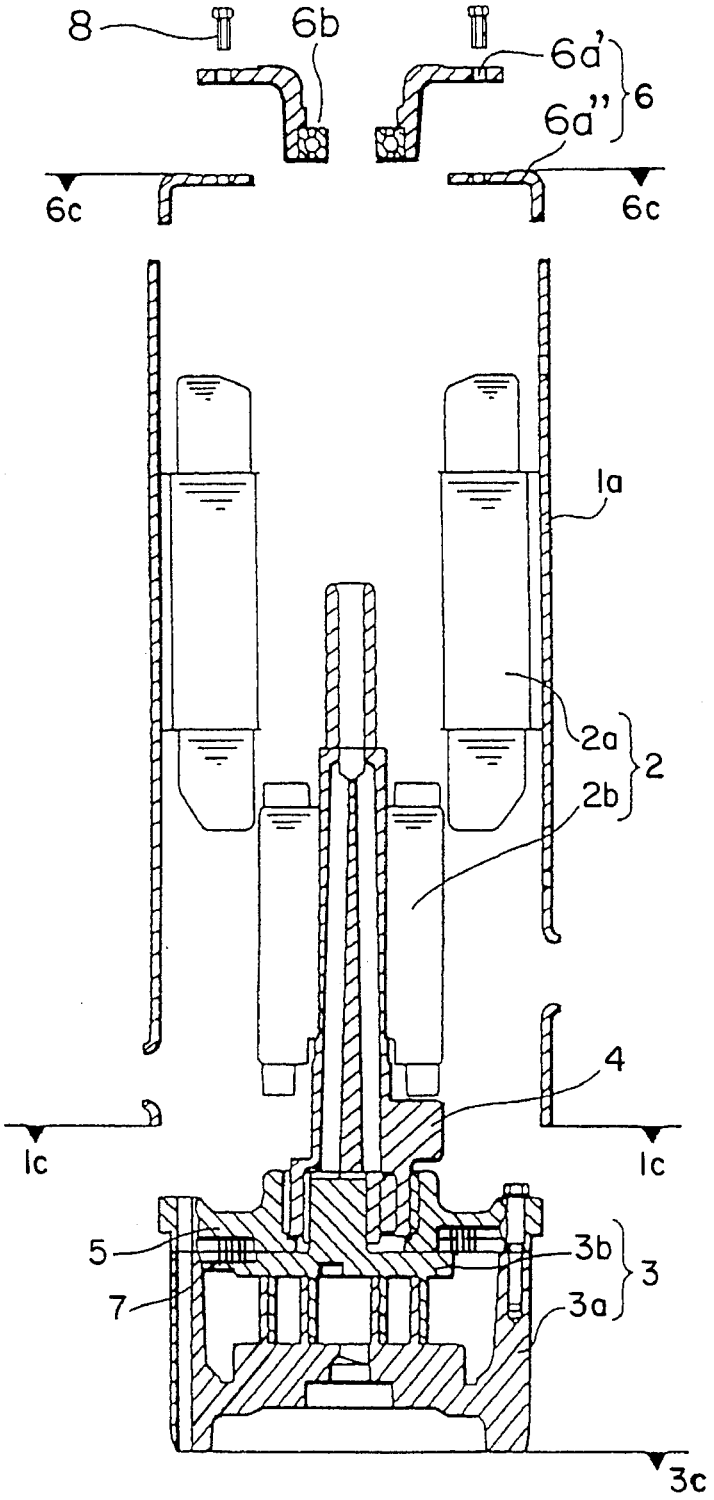
FIG. 5 is a view similar to FIG. 1, but according to a third embodiment of the present invention.

FIG. 5 depicts a scroll compressor according to a third embodiment of the present invention.

The scroll compressor of FIG. 5 differs from that of FIG. 3 in that the former is provided with an auxiliary bearing 6 that is comprised of a first frame 6a', a second frame 6a" secured to the first frame 6a' by means of bolts 8, and a bearing portion 6b carried by the first frame 6a'.

With the above configuration, after the scroll assembly 3, the main bearing 5, and the crank shaft 4 have been assembled highly accurately in a clean or dust-proof room, the assembled elements are inserted into and appropriately welded to the cylindrical section 1a of the closed container 1. Thereafter, the two pins 24 of the jig 20 are inserted into associated reference holes 5e for centering of the main bearing 5, and the second frame 6a" of the auxiliary bearing 6 is welded to the internal surface of the cylindrical section 1a with the external flat plane 6c of the second frame 6a" set parallel to either the flat plane 3c of the stationary scroll 3a or the lower end 1*c* of the cylindrical section 1*a*. Prior to tightening of the bolts 8, the first frame 6*a'* is radially adjusted relative to the second frame 6*a"* to concentrically align the bearing portion 6*b* of the auxiliary bearing 6 with the main bearing 5.

Accordingly, not only can the scroll assembly can be assembled under a clean condition, but also both the main bearing 5 and the auxiliary bearing 6 can be incorporated into the closed container 1 with high accuracy.

It is to be noted that either a sleeve bearing or a roller bearing may be used for the auxiliary bearing 6.

As is clear from the above, according to the present invention, because the scroll assembly can be assembled under a clean condition, no foreign substances enter the scroll assembly. Also, the main bearing and the auxiliary bearing can be assembled highly accurately, thus increasing the reliability of the scroll compressor.

In addition, the scroll compressor of the present invention is easy assemble.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A scroll compressor structure adapted to be assembled using a jig having a cylindrical compression section carrier with a fixed base end and a free end, said scroll compressor structure comprising:

a cylindrical container section having a first end and a second end;

an electric motor accommodated in said cylindrical container section;

a scroll assembly drivably coupled to said electric motor and comprising a stationary scroll and an orbiting scroll, said stationary and orbiting scrolls having respective wrap elements in engagement with each other;

a crankshaft having first and second opposite ends and coupling said orbiting scroll to said electric motor;

a first bearing secured to said cylindrical container section adjacent said first end thereof and supporting said first end of said crankshaft;

a second bearing secured to said cylindrical container section adjacent said second end thereof and supporting said second end of said crankshaft;

wherein said first bearing and said scroll assembly together constitute a compression section having a first end and a second end, said first end of said compression section being the one of said first and second ends of said compression section that is closest to said first end of said cylindrical container section;

wherein said compression section includes a radially outwardly projecting portion which has an outer diameter greater than an outer diameter of a remainder of said compression section, and said radially outwardly projecting portion abuts an inner cylindrical surface of said cylindrical container section so as to locate said compression section concentrically with said cylindrical container section and so as to form a recess about said remainder of said compression section between said outer surface of said compression section and said inner cylindrical surface of said cylindrical container section;

wherein said recess has an open first end at said first end of said compression section, and a closed second end, such that said recess opens axially in a direction toward said first end of said cylindrical container section;

wherein said first end of said cylindrical container section is an open end, and said recess constitutes a means for receiving the cylindrical compression section carrier of the jig projected into said cylindrical container section through said open first end thereof;

wherein said radially outwardly projecting portion of said compression section has an annular surface facing in an axial direction toward said first end of said cylindrical container section and which lies fully in a single plane which is perpendicular to the axial direction;

wherein said annular surface constitutes a means for abutting the free end of the cylindrical compression section carrier of the jig so as to support said compression section in a desired position during assembly and prevent axial sliding movement of said compression section within said cylindrical container section up until such time as said compression section is otherwise fixedly secured in said desired position within said cylindrical container section and the cylindrical compression section carrier is withdrawn from said recess;

wherein said closed second end of said recess is delimited by said annular surface of said radially outwardly projecting portion; and wherein said inner cylindrical surface of said cylindrical container section is equal in diameter at locations on axially opposing sides of said single plane, such that, during assembly, said radially outwardly projecting portion of said compression section is freely slidable in an axial direction along said inner cylindrical surface of said cylindrical container section.

2. The scroll compressor structure according to claim 1; wherein said stationary scroll has a flat plane defined by an end thereof, and said second bearing has a flat plane defined by an end thereof, said flat plane of said stationary scroll and said flat plane of said second bearing being set parallel to each other.

3. The scroll compressor structure according to claim 1, wherein said second bearing comprises a frame portion and a bearing portion carried by said frame portion, said bearing portion being radially adjustable relative to said frame portion.

4. The scroll compressor structure according to claim 2, wherein said second bearing comprises a frame portion and a bearing portion carried by said frame portion, said bearing portion being radially adjustable relative to said frame portion.

* * * * *